United States Patent [19]

Hess et al.

[11] 4,411,758

[45] Oct. 25, 1983

[54] ELECTROLYTIC REDUCTION CELL

[75] Inventors: James B. Hess, Dublin; Erwin O. Strahl, San Ramon, both of Calif.

[73] Assignee: Kaiser Aluminum & Chemical Corporation, Oakland, Calif.

[21] Appl. No.: 298,555

[22] Filed: Sep. 2, 1981

[51] Int. Cl.[3] ..... C25C 3/08

[52] U.S. Cl. ..... 204/243 R; 204/294; 373/122

[58] Field of Search ..... 204/243 R–247, 204/67, 294, 290 R; 373/72, 30, 121, 122

[56] References Cited

U.S. PATENT DOCUMENTS 3,428,545 2/1969 Johnson ..... 204/243 R X
3,773,643 11/1973 Russell et al. ..... 204/243 R
4,140,595 2/1979 Russell et al. ..... 204/67
4,160,715 7/1979 Kinosz et al. ..... 204/243 R
4,175,022 11/1979 Vadla et al. ..... 204/243 R

*Primary Examiner*—Donald R. Valentine
*Attorney, Agent, or Firm*—Edward J. Lynch

[57] ABSTRACT

The deterioration and distortion of the carbonaceous cathode lining of an aluminum reduction cell by freezing of molten cryolitic electrolyte in the lining and its subsequent reaction with sodium intercalated in the carbonaceous lining is substantially reduced by incorporating a composite strata comprised of at least one layer of a high temperature material which is capable of being wetted by molten glass and a layer of ground glass, e.g., cullet, between the carbonaceous lining and an insulating layer of refractory material.

8 Claims, 2 Drawing Figures

ELECTROLYTIC REDUCTION CELL

BACKGROUND OF THE INVENTION

This invention relates to electrolytic cells for the production of aluminum. More particularly, it relates to a novel and improved composite strata which is disposed between the carbonaceous lining and the refractory insulating layer of the cell; said strata preventing distortion and deterioration of the lining, thereby extending the lining life of the cell.

The production of aluminum by the electrolytic reduction of alumina dissolved in a molten salt electrolyte, such as cryolite, is an old and well-known process commonly termed the "Hall-Heroult process". The alumina which is dissolved in the molten or fused electrolyte breaks down into its components, the oxygen being liberated at the anode and metallic aluminum being deposited in a pool or body of molten metal which forms at the bottom of the electrolytic cell. The body of molten aluminum which is formed in the bottom portion of the cell in effect constitutes the cathode of the cell.

There are two types of electrolytic cells for the production of aluminum, namely, the "prebake" cell and the "Soderberg" cell. With either cell the reduction process involves precisely the same chemical reaction. The principal difference between the two cells is one of structure. In the prebake cell the carbon anodes are prebaked before being installed in the cell, whereas in the Soderberg cell, or sometimes referred to as the continuous anode cell, the anode is baked in situ, that is, it is baked during the operation of the cell, thereby utilizing part of the heat generated by the reduction process. The fused electrolyte or bath employed in the Hall-Heroult process consists essentially of cryolite which is a double salt of sodium fluoride and aluminum fluoride having the formula $Na_3AlF_6$, or, expressed in another manner, $3NaF.AlF_3$. Cryolite has a melting point of about 1000° C. Other compounds, including aluminum fluoride up to 10% in excess of the stoichiometric amount of aluminum fluoride in cryolite, 5 to 15% of calcium fluoride, and sometimes several percent of LiF, $MgF_2$ and/or NaCl, may be added to the electrolyte to reduce its liquidus temperature and modify or control such other properties as electrical conductivity, viscosity and surface tension. Alumina concentration is normally maintained between about 2 and 10% by weight. As aluminum metal is produced, the concentration of the alumina decreases and must be periodically replenished.

The conventional aluminum reduction cell is generally comprised of a steel shell, a current-carrying carbonaceous lining disposed therein and one or more carbon anodes disposed within a cavity defined by the carbonaceous lining. The carbonaceous cathode lining may be a monolithic lining which is tamped into place and baked in during the operation of the cell or it may be composed of carbonaceous blocks which have been baked prior to installation in the cell. Embedded in the cathode lining are a plurality of collector bars. Normally, insulating material such as granular alumina or refractory brick is disposed between the steel shell and the carbonaceous lining to conserve the heat generated during the electrolytic process. In many instances the insulating layer is provided only on the bottom portion of the steel shell.

During the service life of the electrolytic cell the carbon linings are subjected to severe chemical and temperature conditions which are deleterious to the carbon lining and consequently the cells have uncertain service lives which may vary from a few days to thousands of days. However, essentially all early cell failures, other than those which stem directly from inadvertently faulty workmanship or other mishaps in a cell's construction, are thought to result because electrolyte penetrates and freezes within the pores and capillary passageways of the carbonaceous lining where it then reacts with elemental sodium to produce reaction products having substantially greater volumes than the original reactants. Where this sodium reaction occurs with electrolyte that is still liquid within the carbon pores, the increased volume of the reaction products can be harmlessly accommodated by an upward displacement of a portion of the overlying liquid within the carbon's capillaries. But where this reaction occurs with electrolyte that has already frozen and been solidly confined within the carbon pores, the increased volume of the reaction products causes a local expansive stress that cracks and comminutes the carbon immediately neighboring the reaction sites. A source of sodium vapor for these reactions is available at all interior surfaces (i.e., pore walls), as well as the exterior surfaces, of the carbon lining because of the well-known sodium intercalation reaction with incompletely graphitized carbon, as described, for example, by E. W. Deming, Trans. AIME, vol. 227, December 1963, pp 1328–1334. The principal expansion is thought to result from one or both of the reactions $$Na_3AlF_6+3Na=Al+6NaF$$

and $$4Na_3AlF_6+12Na+3C=Al_4C_3+24NaF$$

although other sodium reduction reactions, with $CaF_2$ for example, may also be involved. As a general principle, therefore, it is desirable that the electrolyte should neither freeze nor solidify within the carbon.

For energy efficiency, Hall-Heroult cells are commonly designed with enough bottom insulation so that the isotherm for solidification of the electrolyte lies principally in the insulation beneath the carbon, at least initially. During cell operation, however, the insulation is exposed to sodium vapor, fluoride fumes, and infiltration by the molten electrolyte itself, all of which tend to damage the insulation and reduce its insulating value so that the solidification isotherm eventually retreats into the carbon.

Accordingly, it would appear that a barrier of some sort disposed within the electrolytic cell would be required to shield the insulation and to protect it from deterioration by the penetration of molten electrolyte, the penetrations of sodium vapor and the fluoride fumes of the carbon lining and the avoidance of freeze back of the electrolyte or bath into the carbon. In the prior art many barriers have been disclosed and recommended for prolonging the life of carbon linings. For example, overlapping sheets of steel plates disposed between the insulation and the carbon lining have been proposed and have been used in linings of electrolytic cells for aluminum for many years. Also, it has been suggested that GRAFOIL ®, a registered trademark of High Temperature Materials, Inc., be used as a covering layer over the overlapped steel plates. However, the latter material is fragile and expensive, and neither are efficacious in stopping the advance of sodium and fluoride vapors.

The problem of insulation deterioration by penetration of molten electrolyte, sodium vapor and fluoride fumes into the carbon lining of the cell has been recognized in prior patents in regard to electrolytic cells for the production of aluminum. U.S. Pat. No. 3,457,149 to Arthur F. Johnson concerning a method of forming cathode linings proposes a process for filling the pores and fissures of the linings by vacuum-assisted impregnation of the pores and fissures with low melting point halides, such as, calcium chloride or magnesium chloride or sodium chloride to which has been added aluminum chloride or mixtures of fluorides. The process in U.S. Pat. No. 3,457,149 has the serious fault that the carbon ultimately becomes hot enough to melt the low melting point pore filling mixtures, after which they simply dissolve in the bath and their desired sealing effect is lost.

U.S. Pat. Nos. 3,434,957 and 3,649,480, both to Arthur F. Johnson, propose the use of a refractory layer disposed in the lining of the cell such as a refractory coated paper or a paint of aluminum silicate or sodium silicate. Johnson proposes disposing the thin layers between the insulation and carbon lining layers, as well as using it as a paint on the inside of the steel shell of the cell to inhibit tapouts of the molten aluminum.

U.S. Pat. No. 3,514,520 to Bacchiega et al proposes the forming of a barrier between layers of the lining material of an electrolytic reduction furnace for aluminum of powdered or granulated silicon carbide in an incoherent state. According to the patent, this silicon carbide layer constitutes a barrier unsurmountable by molten aluminum.

U.S. Pat. No. 4,033,836 to G. Thomas Holmes proposes the disposition of a layer of aluminum fluoride intermediate the metal shell and the layer of carbonaceous material of the lining of an aluminum electrolytic reduction furnace. This supposedly prevents corrosion of the metal shell by the sodium.

U.S. Pat. No. 3,723,286 to Leland F. Hunt et al proposes the incorporation of a layer of salt such as chloride and fluoride salts of sodium, lithium, calcium and magnesium between the carbon lining and the insulating lining of an electrolytic cell for aluminum to prevent distortion of the carbon lining.

In the production of aluminum metal by the aluminum chloride process, there is a problem with the corrosivity of the chloride bath and its ability to penetrate the refractory linings and attack the steel shell, particularly when the cell is operated at elevated temperatures, e.g., above the melting point of aluminum. At these temperatures, there is a rapid seepage through the cell walls of the electrolytic bath components resulting in a rapid attack of the cell walls. The electrolytes used in the aluminum chloride process, usually composed of aluminum chloride with other chlorides, such as sodium chloride, potassium chloride and lithium chloride, that is, the alkali metal chlorides, are considerably different from the cryolitic electrolytes employed in the Hall-Heroult process; consequently, the types of corrosion and deterioration in the two systems are of substantial difference. In the aluminum chloride process the cell is closed because of the generation of chlorine gas which is highly corrosive to the steel parts of the cell. There are a number of patents which disclose schemes for protecting the steel shell from the detrimental corrosion of the chlorides. U.S. Pat. No. 3,773,643 and 3,779,699, both to Russell et al, propose the interposition of a glass barrier between the steel shell of the cell and the insulation layer of a suitable material, such as refractory bricks. These patents disclose the use of a plurality of glass layers for the barrier. The blass barrier is effectively impervious to penetration by the molten chloride seeping laterally into the sidewalls of the cell.

SUMMARY OF THE INVENTION

Accordingly, it is the primary purpose of this invention to provide a novel, improved barrier layer to shield the insulation layer of the lining of the Hall-Heroult cell from deterioration by the penetration of molten electrolyte or gaseous fluorides or elemental sodium vapors, thereby prolonging the life of the carbon linings of the cell by minimizing deterioration and distortion of the carbon lining.

BRIEF DESCRIPTION OF THE DRAWINGS

The invention will be further understood, and the advantages thereof will become more apparent from the ensuing detailed description when taken in conjunction with the appended drawings which are schematic in character, with various details which are known in the art omitted for the sake of clarity.

DETAILED DESCRIPTION OF THE INVENTION

Figure 1:
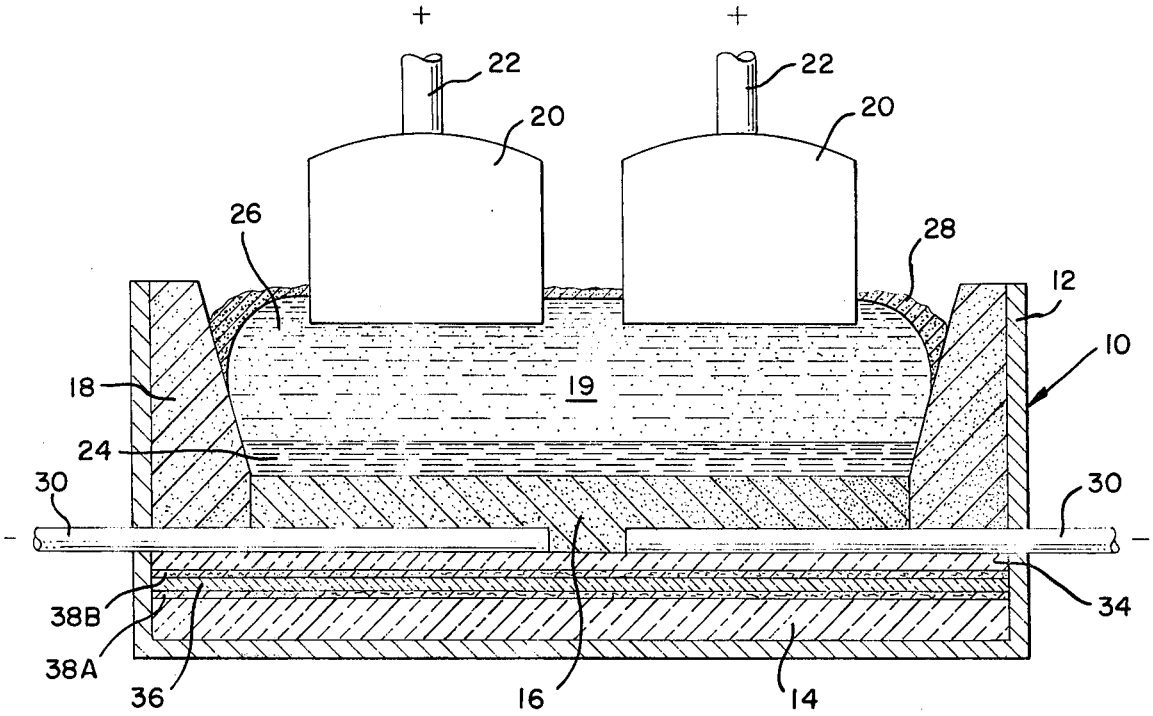
FIG. 1 is a transverse elevation view, partly in section, of an electrolytic cell for the reduction of alumina using prebake anodes and which incorporates an embodiment of the instant invention.

With reference to the drawings which are for the purpose of illustrating rather than limiting the invention and wherein the same reference numerals have been applied to corresponding parts, there is shown in FIG. 1 a transverse elevation view, partly in section, of an aluminum reduction cell of the prebake type. The reduction cell therein depicted is conventional in every respect except for the addition of the composite strata of the invention interposed between the carbon lining and the insulation of the cell. The reduction cell 10 is comprised of a steel shell or vessel 12 having a layer 14 disposed in the bottom thereof of a suitable insulating material, such as alumina or insulating or refractory bricks or combinations thereof, and a carbonaceous bottom layer 16 which is removed from insulating layer 14 by the composite layer of the invention hereafter described, said carbonaceous layer 16 being formed either by a monolithic layer of rammed carbon paste baked in place or by preformed and prebaked carbon blocks. The sidewalls 18 of cell 10 are generally formed of rammed carbon paste; however, other materials such as silicon carbide bricks can be used. The carbonacous layer 16 and the sidewalls 18 define a cavity 19 adapted to contain a molten aluminum body or pad 24 and a molten body of electrolyte or bath 26 consisting essentially of cryolite having alumina dissolved therein. During operation, a crust 28 of frozen electrolyte and alumina is formed over the electrolyte or bath layer 26 and down along the carbon sidewall 18. Alumina is fed to the cell by suitable means (not shown) per a selected schedule. Usually, the alumina is dumped onto the frozen crust layer 28 and periodically the frozen crust layer is broken by suitable means (not shown) to allow the heated alumina to flow into the bath 26 to replenish the same with alumina. Steel collector bars 30 are embedded in the carbonaceous bottom layer 16 and are electrically connected by suitable means at their extremities which protrude through the cell 10 to a cathode bus (not shown). The cell 10 is further comprised of a plurality of carbon anodes 20 supported within the electrolyte 26 by means of steel stubs 22 which are connected mechanically and electrically by suitable conventional means to an electric power source (not shown), such as by anode rods (not shown), which, in turn, are connected to an anode bus (not shown).

In FIG. 1 the composite strata of the invention is shown as a layer of ground glass or cullet sandwiched between two layers of a high temperature material which is capable of being wetted by molten glass. An example of a suitable material is an alumina-silica fibrous material, preferably in strip or blanket form, such as, KAOWOOL, a registered trademark of The Babcock & Wilcox Company, or FIBERFRAX, a registered trademark of The Carborundum Company. Also, suitable would be glass fiber wool in batt or batting form. The layers of the high temperature material are designated as 38A and 38B respectively. A thin layer of alumina, preferably less than ½ inch, is disposed upon the composite strata in order to level out the surface for the disposition of the carbonaceous bottom layer 16. The alumina layer should not be too thick because it would tend to insulate the glass or cullet layer from melting as soon as is desirable. Also, the cullet could serve as the leveling layer by slightly increasing its thickness.

The granular alumina used for the insulation may be the calcined alumina used as feed for the electrolytic cells, although the alumina may be one that is somewhat more stable, that is, it has been more highly calcined and is substantially complete alpha alumina ($\alpha Al_2O_3$) in structure.

Figure 2:
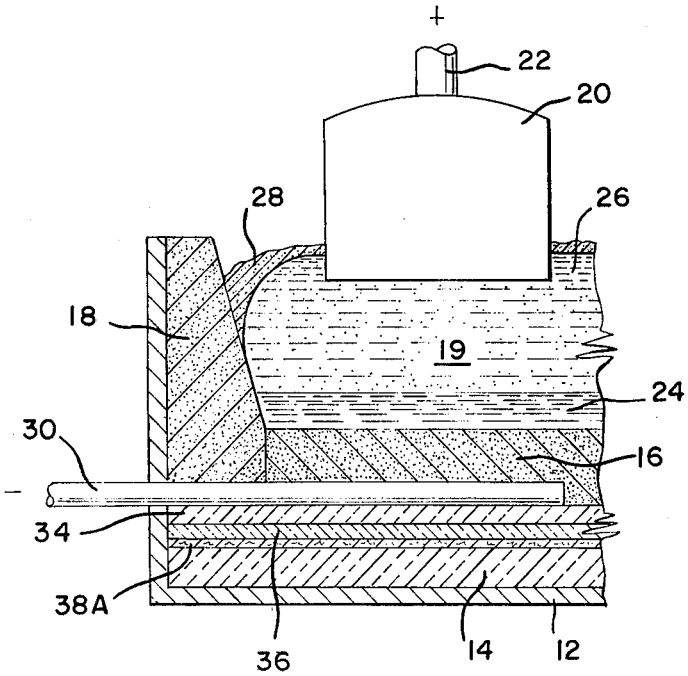
FIG. 2 is a partial view of a portion of the cell similar to that shown in FIG. 1 and wherein is depicted another embodiment of the invention.

The granular glass layer 36 may be of ordinary soda-lime glass, for example, cullet. The glass should have a relatively low softening point (under 800° C.) so that the glass particles will soften and fuse into a continuous plastic layer, thereby forming a nonrigid, conformable barrier when the cell is first heated. With continued cell use, other materials present in the cell, such as $Na_2O$, $CaO$, $Al_2O_3$ and $Na_2O.11Al_2O_3$ will react or fuse with this glass to produce higher melting compounds such as nepheline ($Na_2O.Al_2O_3.2SiO_2$), albite ($Na_2O.Al_2O_3.6SiO_2$), etc., which will convert the temporary plastic glass barrier into a permanent rigid one. The glass layer is of a relatively small thickness, for example, from about ½ inch to about 1 inch. The high temperature material in blanket or batting form, layers 38A and 38B, are also preferably of relatively small thickness, for example, about ¼ inch each. The glass layer, when it becomes viscous, must be contained. It has a high surface tension and tends to ball. The high temperature material layers prevent the tendency of the viscous glass to ball. Because of this characteristic of the viscous glass, there must be at least one layer of the high temperature material disposed either on the top or bottom of the glass layer. This is shown in FIG. 2 which depicts a partial section of the cell and wherein the composite layer comprised of the cullet layer 36 which overlays a bottom layer 38A of the high temperature material. Layer 38A is disposed on top of the alumina insulation layer 14 whereas a thin layer 34 of alumina is preferably disposed on top of the cullet layer 36. Layer 34 could be omitted and the granular cullet layer 36 could be used for leveling out the surface of the disposition of the carbon bottom 16.

The glass layer is a temporary barrier until there is formed a permanent layer of nepheline or albite or other synthetic mineral by interaction of the glass with the elemental sodium vapor emitted from the bottom surface of the intercalated carbon lining. These compounds have higher melting points that the glass from which they form. In fact, their melting points are well above normal bath and cathode temperatures. The albite or nepheline barriers once formed then prevent or inhibit the infiltration of bath through the insulation and the advance of sodium vapor and gaseous fluoride components, thereby preventing degradation and deterioration of the insulation.

It is important that the cell have sufficient bottom insulation so that the zone of freezing for the infiltrated bath (the so-called critical isotherm) is located entirely within the insulation insofar as possible and not within the carbon lining. The composite strata of glass and the high temperature material must then be placed between the carbon lining and that critical isotherm location in order that bath stopped by the barrier will not be allowed to freeze. The glass must also be placed where the temperature is high enough to melt and fuse it soon after cell startup. As a practical matter, these conditions essentially require that the composite barrier be placed quite close to the bottom of the carbon lining.

While the invention has been described with reference to certain specific embodiments, it is obvious that various changes and modifications can be made to the present invention without departing from the spirit of the invention or the scope of the appended claims.

We claim:

1. In a Hall-Heroult-type electrolytic cell containing a molten salt electrolyte composed primarily of fluoride salts and having dissolved in the molten electrolyte alumina which is electrolytically reduced to aluminum metal during the operation of the electrolytic cell, said cell comprising a steel shell, a layer of insulating material on at least the bottom of the shell and a layer of electrically conducting carbonaceous material disposed on at least the insulating layer on the bottom of the shell, the improvement comprising a composite strata interposed between the layer of insulating material and the layer of carbonaceous material on the bottom of the shell, said strata containing at least one layer of ground glass which melts and forms a high melting point barrier layer during the operation of the cell, the high melting point barrier preventing the penetration of electrolyte components, sodium vapor and gaseous fluorides into the insulating layer beneath the glass layer and at least one layer of a high temperature resistant layer wettable by the molten glass which maintains the molten glass in a continuous layer until the glass forms the high melting point barrier.

2. The electrolytic cell of claim 1 wherein the glass is a low temperature glass having a softening point of under 800° C.

3. The electrolytic cell of claim 1 in which the layer of ground glass is sandwiched between two layers of a high temperature material capable of being wetted by molten glass.

4. The electrolytic cell of claim 3 wherein the glass layer is of a thickness from about ½ inch to about 1 inch, and the layers of high temperature material are each about $\frac{1}{4}$ inch in thickness.

5. The electrolytic cell of claim 1 in which the high temperature material is an alumina-silica fibrous material in blanket form.

6. The electrolytic cell of claim 1 in which the high temperature material is glass fiber wool in batting form.

7. The electrolytic cell of claim 1 wherein the glass layer is of a thickness from about $\frac{1}{2}$ inch to about 1 inch.

8. The electrolytic cell of claim 1 wherein the layer of the high temperature material is about $\frac{1}{4}$ inch in thickness.

* * * * *